US012270414B2

(12) United States Patent
Kitamura

(10) Patent No.: US 12,270,414 B2
(45) Date of Patent: Apr. 8, 2025

(54) PIPE DIFFUSER FOR CENTRIFUGAL COMPRESSOR

(71) Applicant: HONDA MOTOR CO., LTD., Tokyo (JP)

(72) Inventor: Eijiro Kitamura, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 18/409,890

(22) Filed: Jan. 11, 2024

(65) Prior Publication Data

US 2024/0309885 A1 Sep. 19, 2024

(30) Foreign Application Priority Data

Mar. 17, 2023 (JP) ..... 2023-042582

(51) Int. Cl.
*F04D 29/44* (2006.01)
*F01D 9/02* (2006.01)
*F01D 9/04* (2006.01)

(52) U.S. Cl.
CPC ..... *F04D 29/441* (2013.01); *F01D 9/02* (2013.01); *F01D 9/04* (2013.01)

(58) Field of Classification Search
CPC ..... F04D 29/441; F01D 9/02; F01D 9/04
See application file for complete search history.

(56) References Cited

U.S. PATENT DOCUMENTS 3,420,435 A * 1/1969 Kenny ..... F04D 29/441 415/206
4,368,005 A * 1/1983 Exley ..... F01D 9/045 415/207
6,280,139 B1 * 8/2001 Romani ..... F04D 29/441 415/207
8,235,648 B2 * 8/2012 LeBlanc ..... F02C 3/08 415/58.4
10,473,115 B2 11/2019 Kreienkamp et al.
2015/0226232 A1 * 8/2015 Duong ..... F04D 29/684 415/203
2017/0362947 A1 * 12/2017 Nasir ..... F02C 3/04

FOREIGN PATENT DOCUMENTS

JP 7105563 B2 7/2022

* cited by examiner

*Primary Examiner* — Topaz L. Elliott
*Assistant Examiner* — Andrew J Marien
(74) *Attorney, Agent, or Firm* — Armstrong Teasdale LLP

(57) ABSTRACT

A pipe diffuser is configured to be positioned on an outer periphery of a compressor impeller of a centrifugal compressor, wherein the pipe diffuser defines a plurality of diffuser passages arranged along a circumferential direction, and each diffuser passage includes a throat extending at an angle to a radial direction and having a substantially circular cross section, a tapered section connected to a downstream end of the throat and having a progressively increasing cross sectional area toward a radially outer end thereof, and a curved section connected to a downstream end of the tapered section is curved into an axial direction, the pipe diffuser further defining through holes communicating with respective tapered sections at one ends thereof and an annular communication passage communicating with other ends of the through holes.

7 Claims, 12 Drawing Sheets

PIPE DIFFUSER FOR CENTRIFUGAL COMPRESSOR

TECHNICAL FIELD

The present invention relates to a pipe diffuser for a centrifugal compressor.

BACKGROUND ART

As a diffuser for a centrifugal compressor a blade-type diffuser is known in the art which has a plurality of blades provided between a first side wall and a second side wall along the circumferential direction so that a plurality of diffuser passages (divided passages) are defined between the adjacent blades. See JP7105563B2 (U.S. Pat. No. 10,473,115B), for instance.

In this diffuser, each diffuser passage is defined by the two side walls and a corresponding pair of adjacent blades. A pressure equalizing opening is formed in one of the side walls at an inlet part (throat) of each diffuser passage that is the narrowest. Each pressure equalization opening is connected to a common annular passage located behind the diffuser so that the inlet parts of the diffuser passages communicate with the annular passage via the respective pressure equalization openings. Each pressure equalization opening is formed as a slot extending between two adjacent blades and has the effect of equalizing the pressure at the entrance of the diffuser passages.

Such diffusers for centrifugal compressors often consist of a pipe diffuser in which each diffuser passage is formed by an individual pipe. The diffuser disclosed in JP7105563B2 may also be applied to a pipe diffuser.

However, the inventor of the present application has discovered that a certain problem is created when the prior art disclosed in JP7105563B2 is applied to a pipe diffuser. The problem consisted of an unevenness in the inlet pressures of the diffuser passages. The cause of this problem is attributed to the geometrical shape of the diffuser passages which is unique to the pipe diffuser. The inventor has discovered that this problem can be overcome by appropriately positioning the pressure equalization openings.

SUMMARY OF THE INVENTION

In view of such a problem of the prior art, and the recognition of the inventor, a primary object of the present invention is to provide a pipe diffuser for a centrifugal compressor which can favorably equalize the inlet pressure of the diffuser passages in the pipe diffuser.

In order to accomplish such an object, the present invention provides a pipe diffuser (38) configured to be positioned on an outer periphery of a compressor impeller of a centrifugal compressor, wherein the pipe diffuser defines a plurality of diffuser passages (39) arranged along a circumferential direction, and each diffuser passage includes a throat (68) extending at an angle to a radial direction and having a substantially circular cross section, a tapered section (70) connected to a downstream end of the throat and having a progressively increasing cross sectional area toward a radially outer end thereof, and a curved section (72) connected to a downstream end of the tapered section is curved into an axial direction, the pipe diffuser further defining through holes (76) communicating with respective tapered sections at one ends thereof and an annular communication passage (78) communicating with other ends of the through holes.

According to this aspect, since each through hole communicates with the corresponding tapered section, the inlet pressure of the diffuser passages is made more uniform than when the through holes communicate with the throats. As a result, the operating limit point on the low flow rate side moves to the lower flow rate side with the result that the operable flow rate range extends to the lower flow rate side. Therefore, the centrifugal compressor can be operated in a low flow rate region without causing any undue reduction in efficiency.

In this pipe diffuser, preferably, the one end of each through hole is provided in a part of the tapered section on a same side as a radially inner side of the curved section.

The flow of the compressed air tends to stagnate on a radially inner side of the curved section of each diffuser passage. According to this aspect, the through hole connecting each diffuser passage with the communication passage is provided on the same side as the inside or the radially inner side of the curved section of the diffuser passage so that the inlet pressure of the diffuser passages are made more uniform. Furthermore, growth of the loss region where the compressed air flow is suppressed so that the loss region can be prevented from growing in size.

In this pipe diffuser, preferably, the pipe diffuser includes an annular housing (40) positioned immediately around an outer periphery of the compressor impeller and defining the throats, and a plurality of diffuser pipes (42) attached to an outer periphery of the annular housing to define the curved sections, and each tapered section is defined across the annular housing and the corresponding diffuser pipe.

According to this aspect, the process for forming the diffuser passages is simplified.

In this pipe diffuser, preferably, the housing includes two parts (80, 82) that are joined to each other in the axial direction, and the communication passage is formed by an annular groove provided on a mating surface of at least one (80) of the two parts, and the through holes are passed through a part of the housing.

According to this aspect, the process of forming the communication passage and the through holes is facilitated.

In this pipe diffuser, preferably, at least one protrusion (86) protrudes in the axial direction from one of the two parts of the housing across the communication passage so as to be located between two adjoining through holes.

The pressure of the compressed air may vary from one diffuser passage to another. By providing the protrusion that impedes free air movement within the communication passage, variations in pressure between the different diffuser passages can be minimized.

In this pipe diffuser, preferably, one of the two parts of the housing is provided with a plurality of protrusions (86), and a tip of each protrusion is provided with a threaded hole (88) into which a bolt for joining the two parts of the housing is threaded.

According to this aspect, the two parts of the housing defining the communication passage can be firmly bolted to each other by using the protrusions. Thereby, the housing can be formed as a compact unit, and the two parts of the housing can be joined to each other both firmly and easily.

In this pipe diffuser, preferably, one of the two parts of the housing surrounds the compressor impeller, and the other part of the housing surrounds a combustor (46) and/or a turbine rotor (58) of a gas turbine connected to the compressor impeller.

According to this aspect, the process of forming the communication passage is facilitated. Furthermore, since the communication passage is jointly defined by the housing parts that surrounds the compressor impeller and a combustor and/or a turbine rotor of a gas turbine, the number of component parts can be reduced, and the manufacturing cost can be reduced.

In this pipe diffuser, preferably, the communication passage is defined by an annular pipe (96) positioned adjacent to the tapered sections.

According to this aspect, the process of forming the communication passage is simplified. The one end of each through hole can be provided in a part of the corresponding tapered section near the curved section.

The present invention thus provides a pipe diffuser for a centrifugal compressor which can favorably equalize the inlet pressure of the diffuser passages in the pipe diffuser.

DESCRIPTION OF THE PREFERRED EMBODIMENT(S)

The present invention will be described in the following in terms of specific embodiments with reference to the appended drawings.

First Embodiment

Figure 1:
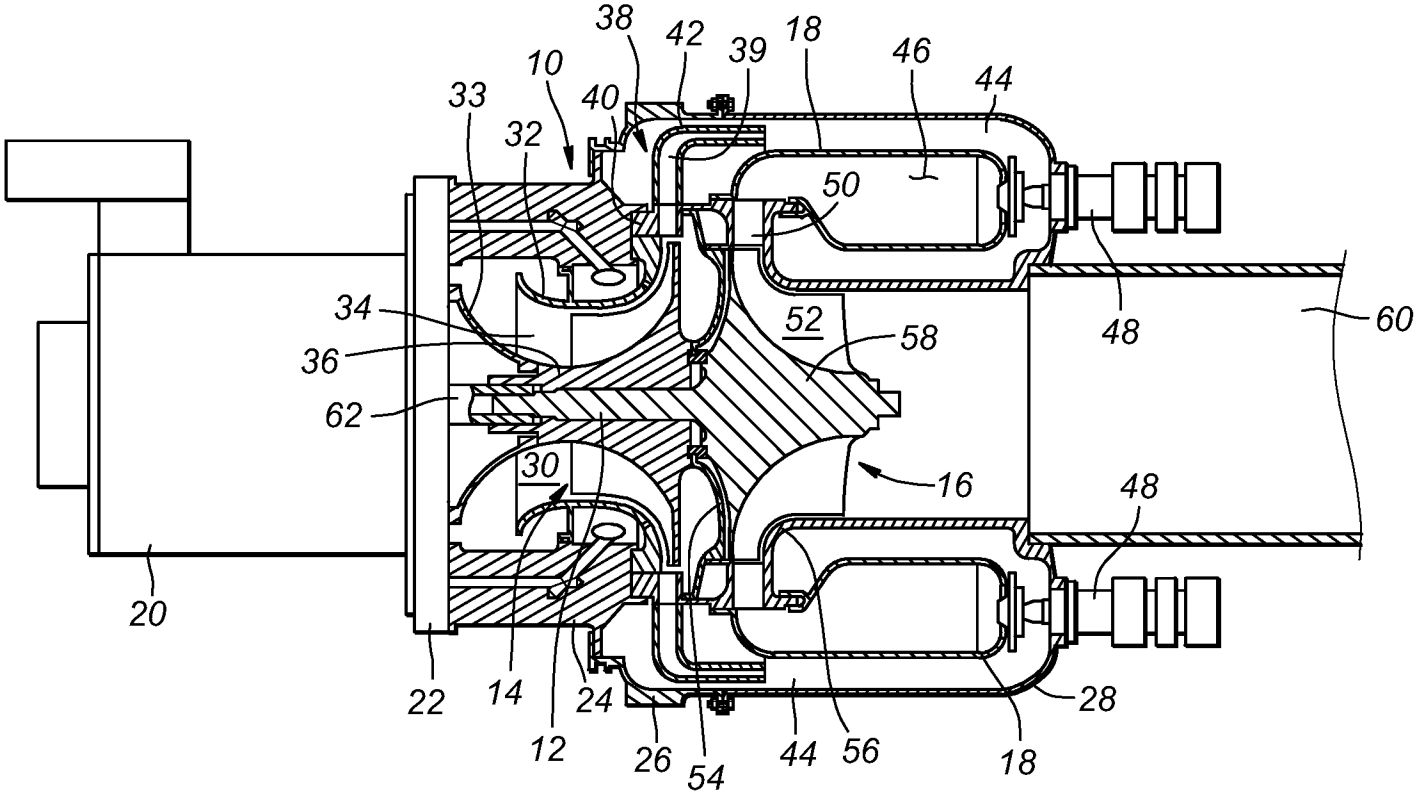
FIG. 1 is a sectional view of a power generation gas turbine system incorporated with a centrifugal compressor according to a first embodiment of the present invention.

FIG. 1 is a sectional view showing a gas turbine system 10 for power generation that includes a centrifugal compressor 14 (radial compressor) according to the first embodiment of the present invention. As shown in FIG. 1, the gas turbine system 10 further includes a radial turbine 16 which is coaxially connected to the centrifugal compressor 14 by a rotating shaft 12, and a combustor 18. The rotating shaft 12 is connected to an input shaft of a generator 20 in a coaxial relationship.

The gas turbine system 10 is generally covered by a housing that includes a front end plate 22 adjoining the generator 20, a front housing part 24, an intermediate housing part 26, and a rear housing part 28, which are connected to each other in the axial direction in this order. The front housing part 24, the intermediate housing part 26, and the rear housing part 28 are generally tubular in shape, and coaxial to one another.

The centrifugal compressor 14 is provided with a compressor shroud 32 which is substantially tubular in shape and attached to the front housing part 24 in a concentric manner so as to define a compressor chamber 30 therein, and an air intake guide member 33 attached to the front end plate 22 in a concentric manner so as to define an air intake opening 34 in cooperation with the compressor shroud 32. A compressor impeller 36 is attached to the rotating shaft 12 so as to be rotatable in the compressor chamber 30. The compressor impeller 36 is rotationally driven by the rotating shaft 12 which is connected to the output shaft of the radial turbine 16.

An annular pipe diffuser 38 for the centrifugal compressor 14 is provided on the outer periphery of the compressor impeller 36. The pipe diffuser 38 consists of an annular middle housing 40 immediately surrounding the outer periphery of the compressor impeller 36 in a coaxial relationship, and a plurality of diffuser pipes 42 extending tangentially from the outer periphery of the middle housing 40. Internal passages defined in the annular middle housing 40 and the hollow interior of the diffuser pipes 42 jointly define a plurality of diffuser passages 39 extending radially and tangentially and separated from one another in the circumferential direction. The annular middle housing 40 is firmly interposed between the front housing part 24 and rear housing part 28.

The centrifugal compressor 14 takes in air (outside air) from an air intake opening 34, compresses (pressurizes) the air by the rotating compressor impeller 36 and blows out the compressed air (pressurized air) into the diffuser passages 39 of the pipe diffuser 38.

The combustor 18 is positioned in the rear housing part 28 concentric to the central axis of the rotating shaft 12. The rear housing part 28 defines a part of a compressed air passage 44 that directs compressed air from the pipe diffuser 38 to the combustor 18 that internally defines a combustor 46. A fuel injection nozzle 48 is attached to the combustor 18 to inject fuel into combustor 46.

In the combustor 46, the fuel injected into the combustor 46 by the fuel injection nozzle 48 is mixed with the compressed air from the centrifugal compressor 14 and is combusted to generate high-pressure combustion gas (compressed fluid). A turbine nozzle 50 of the radial turbine 16 is located at the gas outlet of the combustor 18.

The radial turbine 16 has a turbine chamber 52 defined inside the rear housing part 28 and communicating with the gas outlet of the combustor 18. The turbine chamber 52 is separated from the compressor chamber 30 by a conical partition wall 54. A side of the turbine chamber 52 axially opposite from the partition wall 54 is defined by a substantially cylindrical turbine shroud 56. A radial turbine rotor 58 having an integral rotating shaft 12 is rotatably positioned in the turbine chamber 52.

The turbine nozzle 50 has an annular shape surrounding the radial turbine rotor 58 and injects combustion gas toward the radial turbine rotor 58 in a radially inward and circumferential direction. The radial turbine rotor 58 is rotationally driven by the combustion gas injected from the turbine nozzle 50. The combustion gas that has rotationally driven the radial turbine rotor 58 is discharged into the atmosphere from the exhaust gas passage 60 connected to the rear end of the turbine shroud 56 as exhaust gas.

A rotor shaft (input shaft) 62 of the generator 20 is connected to the rotating shaft 12 so that the generator 20 is rotationally driven by the rotating shaft 12 of the radial turbine 16 and generates electricity.

Next, details of the pipe diffuser 38 will be described in the following with reference to FIG. 2 which is an enlarged sectional view of the upper half of the centrifugal compressor 14. The centrifugal compressor 14 has a substantially conical hub 64 fixedly fitted on the rotating shaft 12, and a plurality of blades 66 (66A, 66B) provided on the outer periphery of the hub 64 circumferentially spaced apart from one another. The blades 66 include full blades 66A extending from the front edge of the hub 64 to the outer periphery of the hub 64 and splitter blades 66B extending from a point some distance behind the front edges of the full blades 66A to the outer periphery of the hub 64 in a circumferentially alternating manner. The blades 66 are curved radially outwardly toward the rear, and the trailing edges of the blades 66 extend linearly and face radially outward.

The pipe diffuser 38 defines a plurality of diffuser passages 39 through which the compressed air ejected radially outward from the centrifugal compressor 14 flows. Each diffuser passage 39 has, in order from the upstream side, a throat 68, a tapered section 70, a curved section 72, and an axial section 74.

The throat 68 is the narrowest part of the diffuser passage 39 and has a predetermined length. The throat 68 is formed in the radially inner part of the middle housing 40 and extends radially outward through the pipe diffuser 38 with a certain inclination in the circumferential direction. The throat 68 has a constant circular cross-sectional shape along the length of the diffuser passage 39. Here, being circular does not necessarily mean a true circle, but may be any substantially circular shape, and may be an ellipse or track shaped.

The tapered section 70 is continuous with the throat 68 and has a cross-sectional area that gradually increases in the radially outward direction. The tapered section 70 is formed across the middle housing 40 and the diffuser pipe 42 or by both the middle housing 40 and the diffuser pipe 42. The tapered section 70 also has a circular cross-sectional shape like the throat 68. However, the cross-sectional shape of the tapered section 70 may also be an ellipse that gets longer in the circumferential direction toward the radially outer side thereof.

The curved section 72 is formed in a rear part of each diffuser pipe 42 and at an outer circumferential part of the pipe diffuser 38. The curved section 72 is continuous with the tapered section 70 and curves from the circumferential direction to the axial direction of the pipe diffuser 38. An axial section 74 is connected to the rear end of curved section 72 so as to be continuous with the curved section 72 and is inclined in the circumferential direction with respect to the axial direction. The rear end of the axial section 74 is directed in a rearward and circumferential direction in the compressed air passage 44 and communicates with the compressed air passage 44.

As described above, the pipe diffuser 38 includes the annular middle housing 40 and the diffuser pipes 42 attached to the outer periphery of the middle housing 40, and the tapered section 70 extends between the middle housing 40 and the diffuser pipes 42. This facilitates the process of forming the diffuser passages 39.

Figure 3:
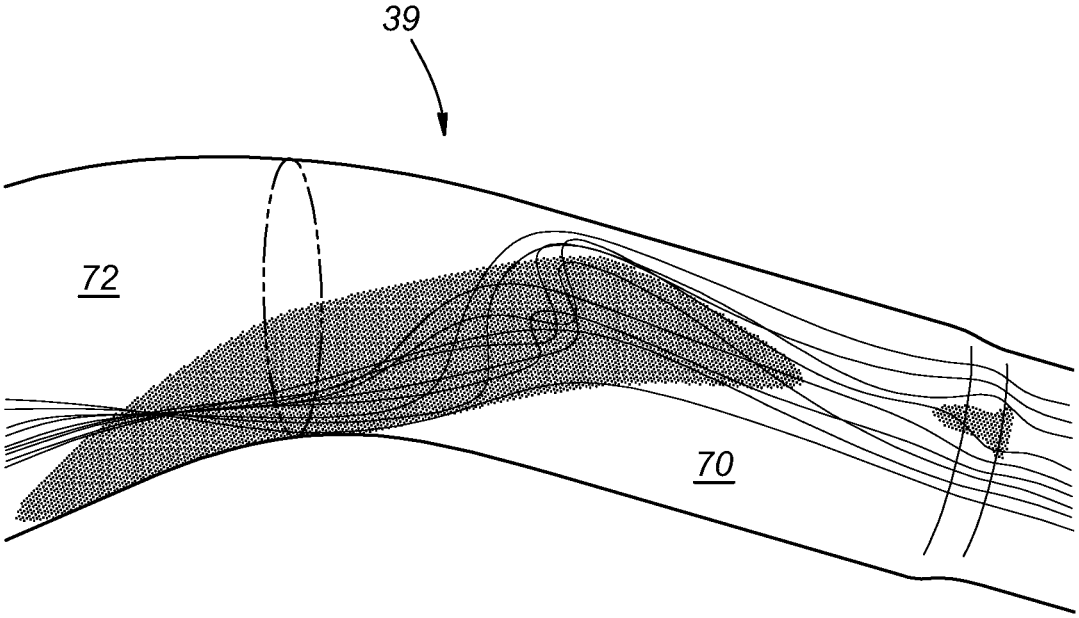
FIG. 3 is a diagram showing air flow and loss in a diffuser passage.

FIG. 3 is a diagram illustrating the air flow and how air flow loss is caused in the diffuser passage 39. This diagram illustrates a downstream part of the tapered section 70 and the curved section 72 of the diffuser passage 39. The curved lines shown in this diagram represent the flow of the compressed air. The compressed air flows from right to left in FIG. 3. The shaded area represents an area of a high loss where the air flow is poor (low velocity or reverse flow). As shown in this diagram, the curved lines intersect with each other inside the curved section 72. In other words, the flow of the compressed air is disturbed and tends to stagnate. Therefore, the radially inner part of the curved section 72 is considered to be an area of high loss. When fuel is injected into the combustor 18 and the pressure on the downstream side of the centrifugal compressor 14 increases, this loss region extends upstream particularly when the operating point is on the low flow rate side. As the loss region expands toward the upstream side, the flow velocity of the compressed air decreases with the result that the limit performance of the centrifugal compressor 14 decreases.

Figure 2:
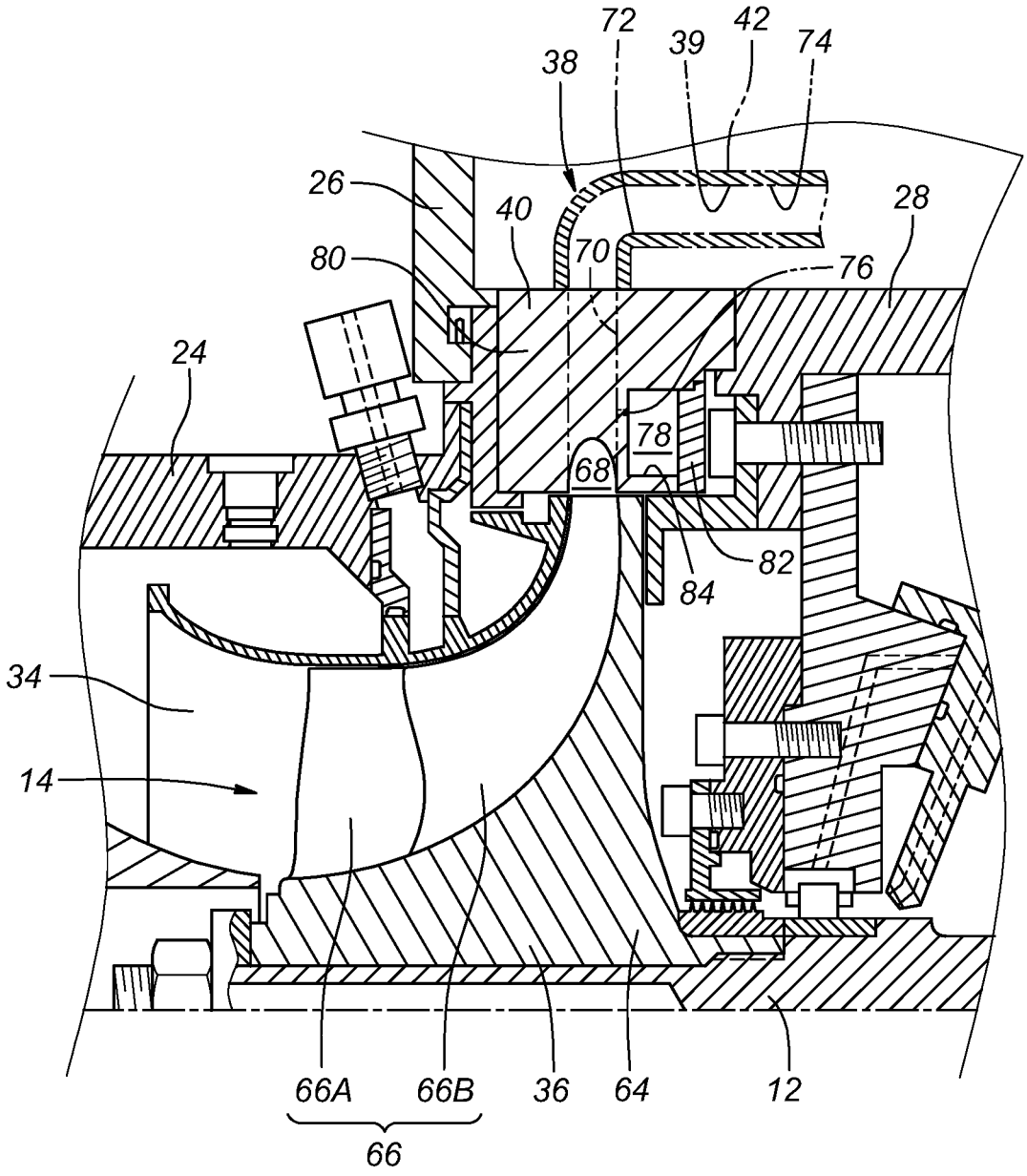
FIG. 2 is an enlarged sectional view of the upper half of the radial compressor of the power generation gas turbine system.

In order to minimize performance deterioration of the centrifugal compressor 14, the pipe diffuser 38 is provided with a plurality of through holes 76 and a communication passages 78, as shown in FIG. 2. The through holes 76 are formed in the middle housing 40 so as to correspond to the respective diffuser passages 39, and each through hole 76 communicates with the tapered section 70 of the corresponding diffuser passage 39 at one end and communicates with the communication passage 78 at the other end. By communicating the through holes 76 with the tapered section 70, the inlet pressure of the diffuser passages 39 is made uniform. As a result, the flow rate of compressed air flowing from the compressor impeller 36 to the pipe diffuser 38 is stabilized, and the operating limit point on the low flow rate side is moved to the low flow rate side. Details will be explained later.

Note that the inlet pressures of the diffuser passages 39 are made uniform owing to the presence of the through holes 76. This is particularly the case where each through hole 76 is provided in the tapered section 70 as opposed to the case where each through hole 76 is provided in the throat 68. When each through hole 76 is provided so as to communicate with the throat 68 that controls the flow rate of compressed air, the effective cross sectional area of the throat 68 changes due to the presence of the through hole 76, and the choke flow rate is changed due to the presence of the through hole 76. In contrast, in this embodiment, each through hole 76 is provided at a position communicating with the tapered section 70, thereby suppressing an increase in the difference in the choke flow rate. In particular, an unevenness in the inlet pressures of the diffuser passages 39 owing to manufacturing errors can be avoided.

More specifically, one end of each through hole 76 communicates with a rear side of the tapered section 70 which is on the same side as the radially inner side of the curved section 72. As a result, the inlet pressures of the diffuser passages 39 are made particularly uniform. Furthermore, the loss region where the flow of the compressed air is obstructed is prevented from growing.

The communication passage 78 is formed in an annular shape at the rear of the middle housing 40 which is adjacent to the rear ends of the through holes 76. The communication passage 78 allows the other ends of the through holes 76 to communicate with one another. In this embodiment, the communication passage 78 is formed in a complete annular shape. Therefore, the other ends of all the through holes 76 communicate with one another via the common communication passage 78. However, the communication passage 78 may also be divided into a plurality of segments along the circumferential direction by one or more partition walls 79 (see FIG. 5). In such a case, each group consisting of a certain number of adjoining through holes 76 communicate with the corresponding segment of the communication passage 78.

The middle housing 40 is composed of a housing front part 80 and a housing rear part 82 which are axially joined to each other. The housing front part 80 is a main body that defines an annular groove 84 on a rear side thereof in a forwardly recessed manner, and the housing rear part 82 consists of an annular plate which is attached to the housing front part 80 from behind so as to close the annular groove 84 so that the communication passage 78 is formed jointly by the housing front part 80 and the housing rear part 82. A part of each diffuser passage 39 (the throat 68 and at least a most part of the tapered section 70) is formed in the housing front part 80, and the through holes 76 are also formed in housing front part 80 across the bottom wall of the annular groove 84. Thus, forming the communication passage 78 and the through holes 76 is facilitated.

Figure 4:
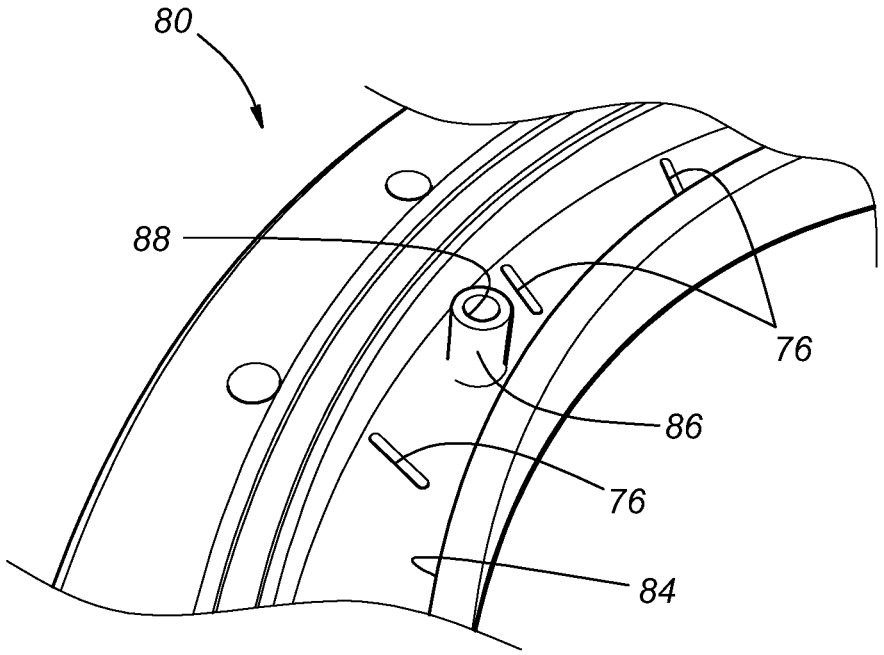
FIG. 4 is a fragmentary rear perspective view of a housing part.
Figure 5:
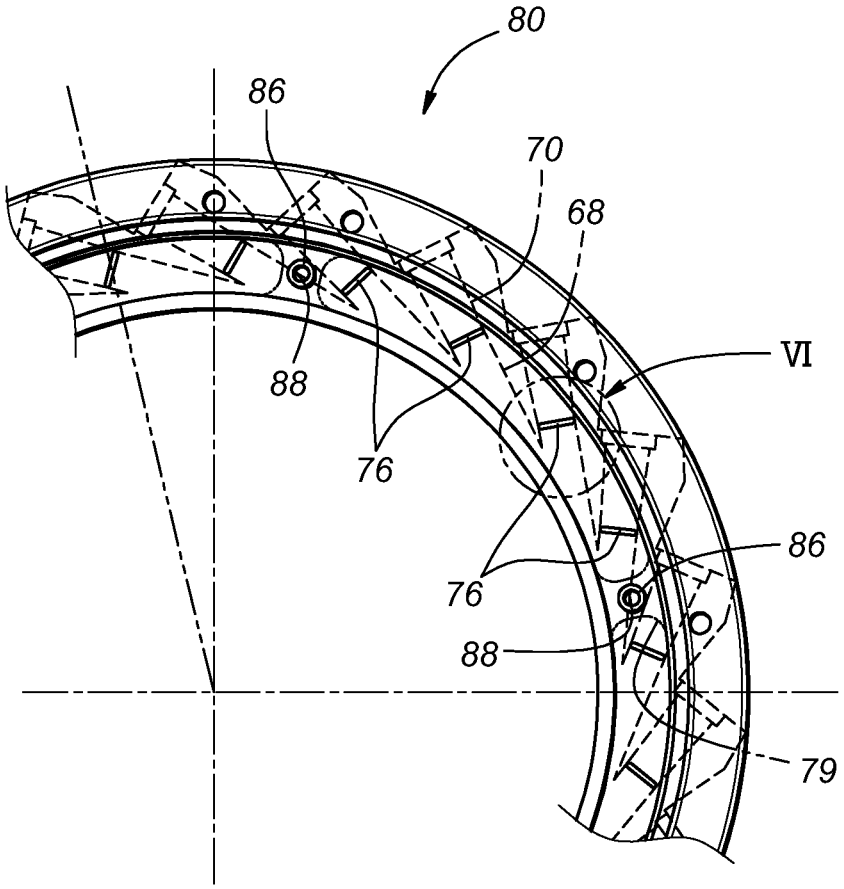
FIG. 5 is a fragmentary rear view of the housing part.

FIG. 4 is a fragmentary perspective rear view the housing front part 80, and FIG. 5 is a fragmentary rear view of the housing front part 80. As shown in FIGS. 4 and 5, the through holes 76 are formed as slots elongated in a direction orthogonal to the axis of the diffuser passage 39. Since the throats 68 and the tapered sections 70 are inclined in the circumferential direction with respect to the radial direction, the long axis of each through hole 76 is inclined with respect to the circumferential direction of the annular groove 84.

Figure 6:
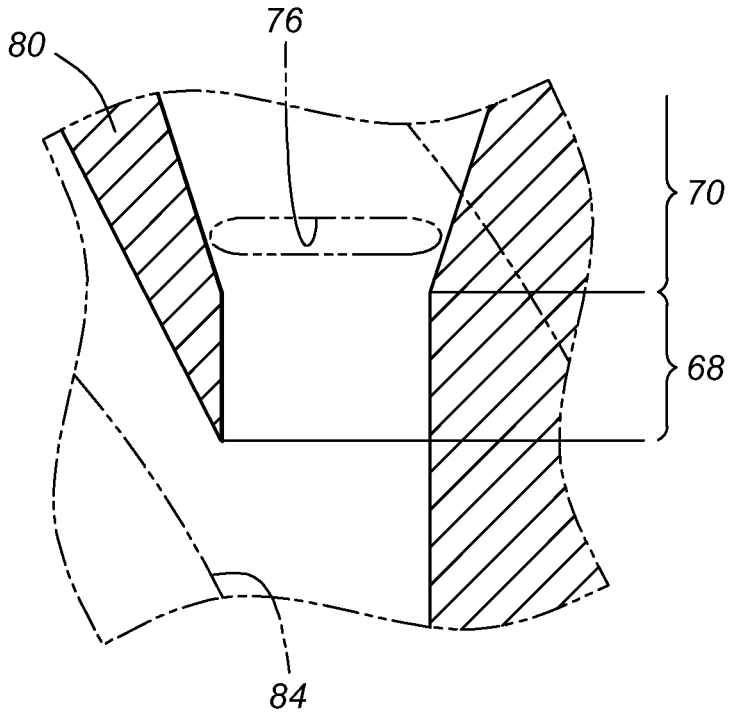
FIG. 6 is a fragmentary sectional view showing the positioning of a through hole in a diffuser passage.

FIG. 6 is an enlarged sectional view of the part of FIG. 5 indicated by roman numeral VI diagram and shows the positioning of the through hole 76 in the diffuser passage 39. As shown in FIG. 6, the one end (front end) of the through hole 76 is located near the upstream end of the tapered section 70, or a part of the tapered section 70 near the throat 68. Thereby, stalling of the fluid flowing within the centrifugal compressor 14 is effectively suppressed.

As shown in FIGS. 4 and 5, the housing front part 80 is formed with a plurality of protrusions 86 that protrude axially rearward from the bottom surface of the annular groove 84 and are arranged evenly along the circumferential direction. Each protrusion 86 has a width smaller than the width of the annular groove 84 and a height substantially equal to the depth of the annular groove 84. The protrusion 86 is positioned between the corresponding two adjoining diffuser passages 39. Preferably, the protrusions 86 are each provided for every four or five diffuser passages 39. In other words, four or five through holes 76 are formed between each adjoining pair of protrusions 86 along the circumferential direction.

The pressure of the compressed air may vary from one diffuser passage 39 to another. In this embodiment, since the housing front part 80 has the protrusions 86 positioned between the two through holes 76, variations in the pressure between the different diffuser passages 39 are reduced.

A female thread 88 is formed on the tip end surface of each protrusion 86 for threading a bolt for attaching the housing rear part 82 to the housing front part 80. Thereby, the housing rear part 82 covering the annular groove 84 can be bolted to the housing front part 80 by using the protrusion 86. Since there is no need to form a boss for forming a female thread for the bolt, the structure of the pipe diffuser 38 is simplified.

The pipe diffuser 38 is configured as described above. Next, the effect of the pipe diffuser 38 configured in this way will be discussed in the following.

Figure 7:
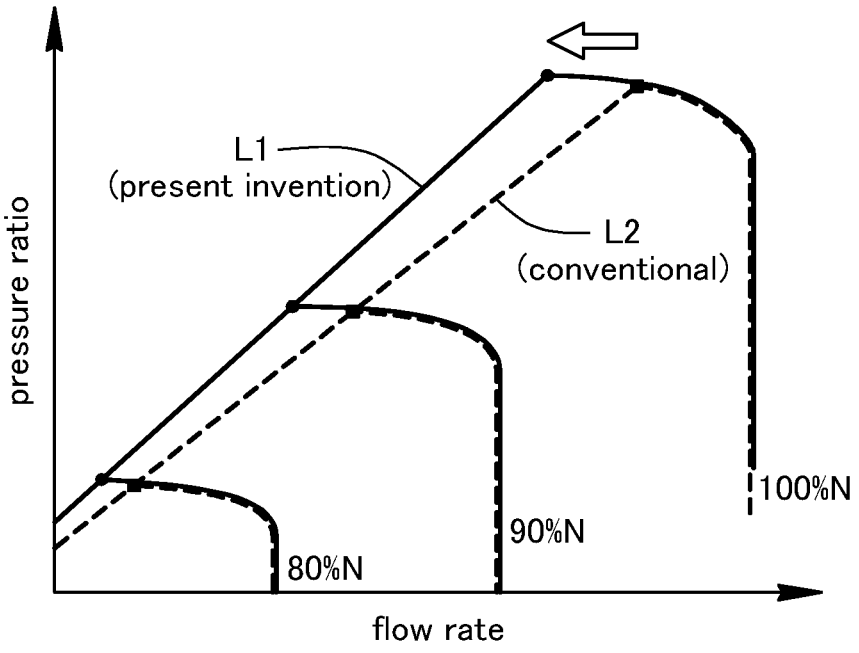
FIG. 7 is a graph showing the flow rate vs. pressure ratio characteristics of the centrifugal compressor.

FIG. 7 is a graph showing the flow rate vs. pressure ratio characteristics of the centrifugal compressor. In FIG. 7, the solid curved lines indicate the performance of the centrifugal compressor using the pipe diffuser 38 of this embodiment, and the broken curved lines indicate the performance of a comparable conventional centrifugal compressor in which the through holes 76 are not provided. For both centrifugal compressors, the results are shown at three rotational speeds: 80% N, 90% N, and 100% N, where the design rotational speed of the centrifugal compressor is 100% N. In the centrifugal compressor using the pipe diffuser 38 of this embodiment, the limit line L1 indicating the operating limit is shifted to the left (low flow rate region) compared to the limit line L2 of the conventional centrifugal compressor so that the operating range of the centrifugal compressor is expanded.

Figure 8:
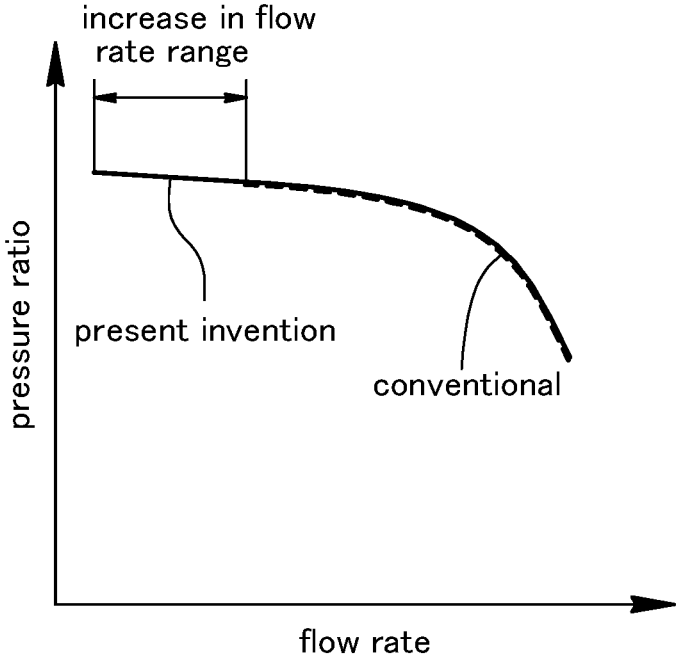
FIG. 8 is a graph showing an improvement in the flow rate vs. pressure ratio characteristics of a centrifugal compressor.
Figure 9:
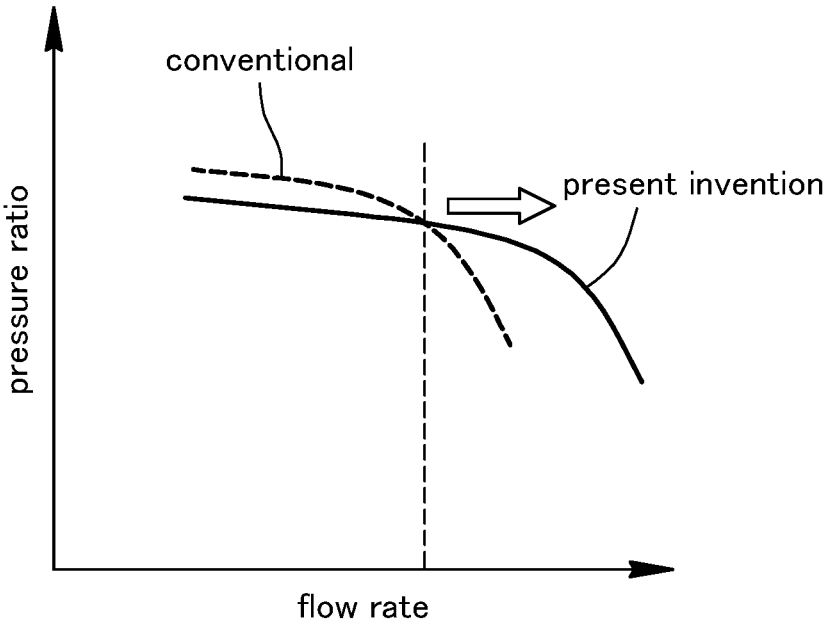
FIG. 9 is a graph comparing the flow rate vs. pressure ratio characteristics of the centrifugal compressor of the present invention with those of a conventional centrifugal compressor.
Figure 10:
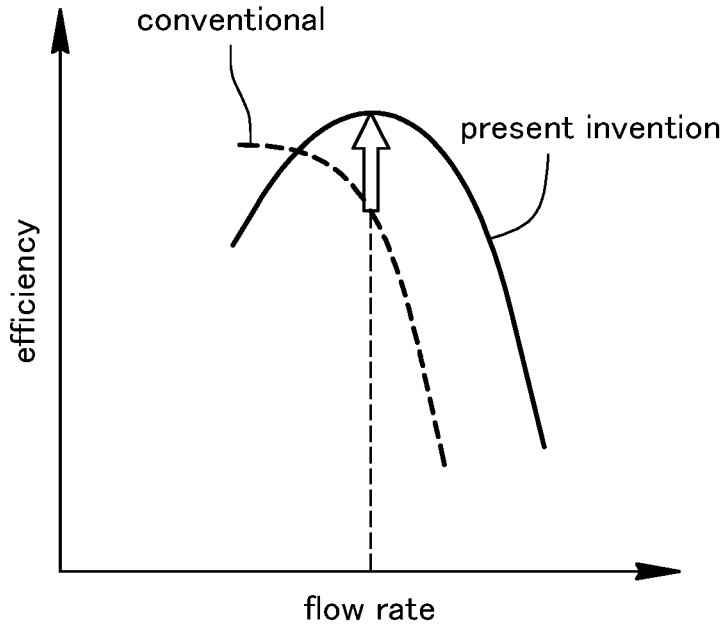
FIG. 10 is a graph comparing the flow rate vs. efficiency characteristics of the centrifugal compressor of the present invention with those of a conventional centrifugal compressor.

More specifically, as shown in FIG. 8, in this embodiment, the operable flow rate range is increased over that of the conventional centrifugal compressor by an amount corresponding to the increase in the flow rate range shown in this graph. Therefore, as shown in FIG. 9, in the centrifugal compressor of the illustrated embodiment, the design flow rate can be increased by the amount corresponding to the increase in the flow rate range. Therefore, as shown in FIG. 10, when operating with a predetermined flow rate, the power generation gas turbine system 10 can be operated in a region with a high compressor efficiency so that the fuel efficiency of the power generation gas turbine system 10 can be improved.

Second Embodiment

Next, a second embodiment of the present invention will be described in the following with reference to FIG. 11. Note that the parts corresponding to those of the previous embodiment will be denoted with like reference numerals without necessarily repeating the description of such parts to avoid redundancy. The same will be true in regard to subsequent embodiments.

Figure 11:
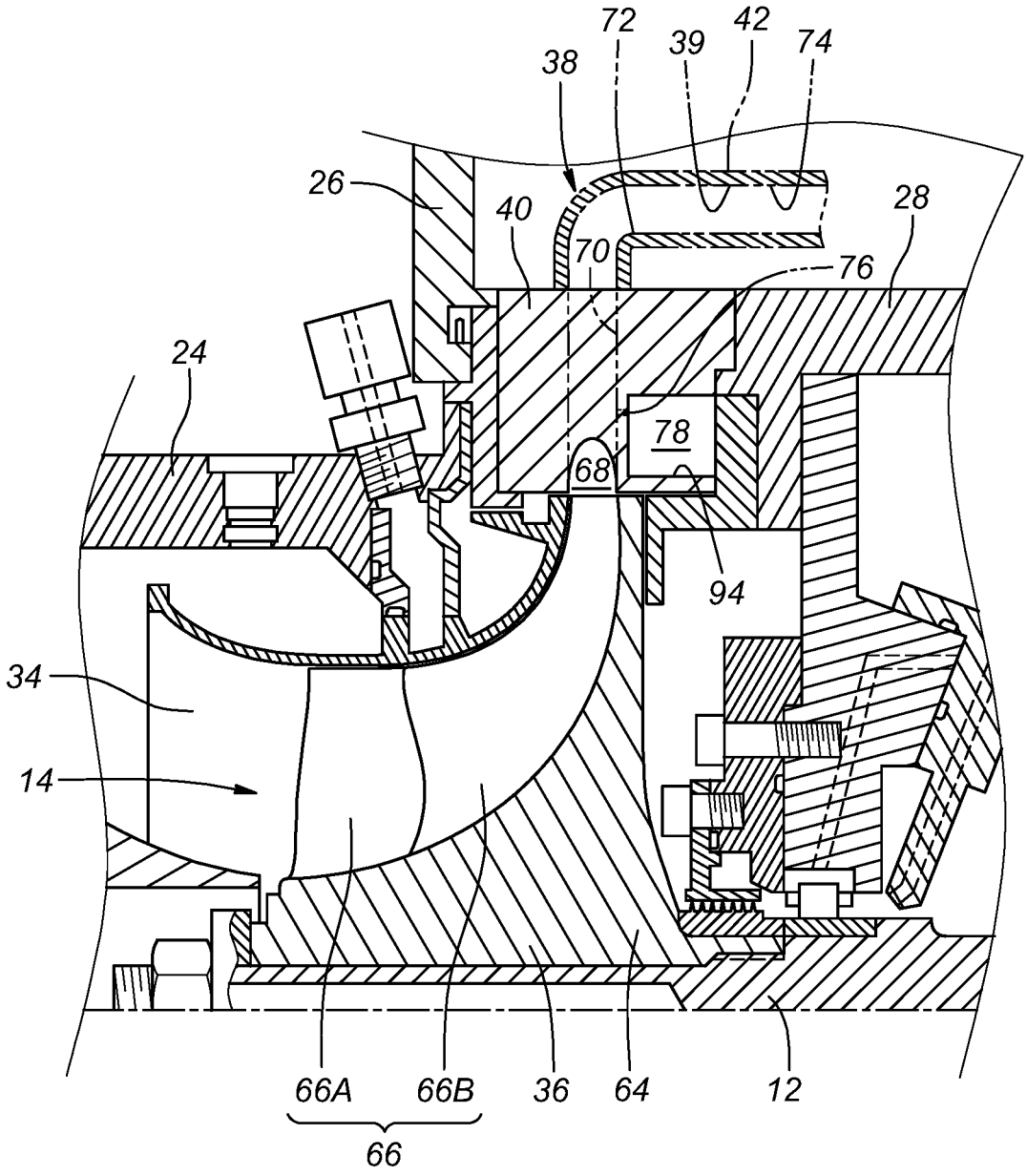
FIG. 11 is a view similar to FIG. 2 showing a centrifugal compressor according to a second embodiment of the present invention.

FIG. 11 is an enlarged sectional view of the upper half of the centrifugal compressor 14 and the surrounding parts thereof according to the second embodiment of the present invention. In this embodiment, the middle housing 40 is not divided into the front and rear housing parts, and consists of a single piece member. The middle housing 40 is fastened to the front surface (one of the axial surfaces) of the rear housing part 28 which houses the combustor 46 and the turbine rotor 58 by bolts (not shown in the drawings). An annular groove 94 forming a communication passage 78 is formed as an annular recess formed on the rear surface of the middle housing 40. The annular groove 94 is open toward the rear, but is closed by the rear housing part 28 when the middle housing 40 is attached to the rear housing part 28. The through hole 76 is provided in the bottom wall of the annular groove 94.

Even if the pipe diffuser 38 is configured in this way, the same action and effects as in the first embodiment can be achieved. In this embodiment also, since the communication passage 78 is formed by the annular groove 94, forming the communication passage 78 is facilitated. Furthermore, since the open surface of the communication passage 78 is covered by the rear housing part 28, there is no need for a member that covers the open surface like the housing rear part 82 of the first embodiment. Therefore, manufacturing cost may be reduced even further.

Third Embodiment

Figure 12:
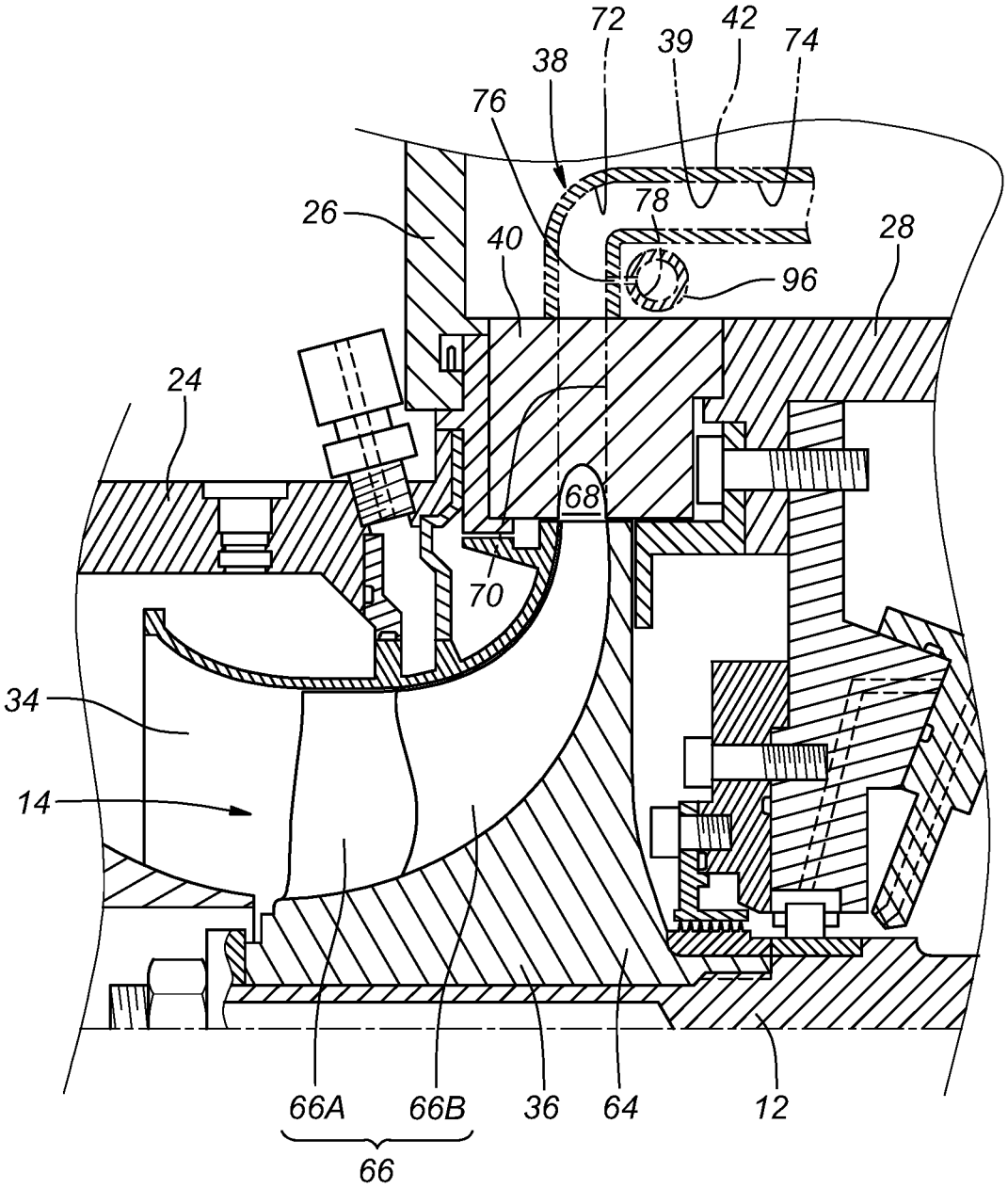
FIG. 12 is a view similar to FIG. 2 showing a centrifugal compressor according to a third embodiment of the present invention.

Next, a third embodiment of the present invention will be described in the following with reference to FIG. 12 which is an enlarged sectional view of the upper half of the radial compressor according to the third embodiment. In this embodiment, the communication passage 78 is not formed in the middle housing 40. Instead, the pipe diffuser 38 is provided with a hollow annular member 96 adjacent to or in contact with the rear surface of the diffuser pipes 42, that is, the rear surface on the same side as the radially inner side of the curved section 72. The annular member 96 is made of a pipe having a circular or rectangular cross section, and is formed in a complete annular shape on the outer periphery of the middle housing 40. The communication passage 78 is defined inside the annular member 96, and one end of each through hole 76 is located in a part of the tapered section 70 defined by the corresponding diffuser pipe 42, in particular a downstream part of the tapered section 70 which is immediately upstream of the curved section 72.

In this embodiment also, the action and effects similar to those of the first embodiment can be achieved. In this embodiment, since the communication passage 78 is formed by a pipe member, forming of the communication passage 78 can be facilitated. Further, the end of each through hole 76 can be provided in a part of the tapered section 70 near the curved section 72.

The present invention has been described in terms of specific embodiments, but is not limited by such embodiments, and can be modified in various ways without departing from the scope of the present invention, For example, the pipe diffuser 38 can be applied not only to centrifugal compressors for power generation gas turbine systems 10 but also to centrifugal compressors for aircraft gas turbine engines. Further, the shape of each through hole 76 is not limited to a slot-shape, but may also be circular or rectangular. The annular groove 84 was formed on the rear surface of the housing front part 80 in the first embodiment, but may instead be formed on the front surface of the housing rear part 82. Further, in the first embodiment, the protrusions 86 were provided on the housing front part 80, but may instead be provided on the housing rear part 82. In addition, the specific structure, arrangement, quantity, material, etc. of each member or portion can be changed and substituted as appropriate without departing from the scope of the present invention. Further, some or all of the configurations in various embodiments may be combined with each other. On the other hand, all of the constituent elements shown in the above embodiments are not necessarily essential for the present invention and can be selected and substituted as appropriate.

The invention claimed is:

1. A pipe diffuser configured to be positioned on an outer periphery of a compressor impeller of a centrifugal compressor, wherein the pipe diffuser defines a plurality of diffuser passages arranged along a circumferential direction, and each of the plurality of diffuser passages includes a throat extending at an angle to a radial direction, a tapered section connected to a downstream end of the throat and having a progressively increasing cross sectional area toward a radially outer end thereof, and a curved section connected to a downstream end of the tapered section is curved into an axial direction, the pipe diffuser further defining through holes communicating with the respective tapered sections at one ends thereof and an annular communication passage communicating with other ends of the through holes, wherein the one end of each of the through holes is provided in a part of the tapered section on a same side as a radially inner side of the curved section.

2. The pipe diffuser according to claim 1, further including an annular housing positioned immediately around the outer periphery of the compressor impeller and defining the throats, and a plurality of diffuser pipes attached to an outer periphery of the annular housing to define the curved sections, and each of the tapered sections is defined across the annular housing and the corresponding diffuser pipe.

3. The pipe diffuser according to claim 2, wherein the annular housing includes two parts that are joined to each other in the axial direction, and the annular communication passage is formed by an annular groove provided on a mating surface of at least one of the two parts, and the through holes are passed through a part of the annular housing.

4. The pipe diffuser according to claim 3, wherein at least one protrusion protrudes in the axial direction from one of the two parts of the annular housing across the annular communication passage so as to be located between two adjoining through holes.

5. The pipe diffuser according to claim 4, wherein one of the two parts of the annular housing is provided with a plurality of protrusions, and a tip of each of the protrusions is provided with a threaded hole into which a bolt for joining the two parts of the annular housing is threaded.

6. The pipe diffuser according to claim 3, wherein one of the two parts of the annular housing surrounds the compressor impeller, and the other part of the annular housing surrounds a combustor and/or a turbine rotor of a gas turbine connected to the compressor impeller.

7. The pipe diffuser according to claim 2, wherein the annular communication passage is defined by an annular pipe positioned adjacent to the tapered sections.

* * * * *